US006742724B2

(12) United States Patent
Duqueroie

(10) Patent No.: US 6,742,724 B2
(45) Date of Patent: Jun. 1, 2004

(54) DEVICE FOR DISPENSING A PRODUCT, PARTICULARLY PRODUCT SAMPLES, AS A SPRAY

(75) Inventor: Florent Duqueroie, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 10/145,046

(22) Filed: May 15, 2002

(65) Prior Publication Data

US 2003/0006309 A1 Jan. 9, 2003

(30) Foreign Application Priority Data

May 15, 2001 (FR) ..... 01 06390

(51) Int. Cl.[7] ..... B05B 11/04

(52) U.S. Cl. ..... 239/328; 239/302; 239/569; 239/571; 222/92

(58) Field of Search ..... 239/328, 302, 239/569, 570, 571, 576, 320, 327; 222/92–107, 494, 496

(56) References Cited

U.S. PATENT DOCUMENTS

| | | | | | |
|---|---|---|---|---|---|
| 1,617,545 | A | * | 2/1927 | Salpas | 239/327 |
| 2,961,169 | A | * | 11/1960 | Nyden | 239/327 |
| 3,170,633 | A | * | 2/1965 | Castelli | 239/327 |
| 3,412,907 | A | * | 11/1968 | Faso | 222/187 |
| 3,474,936 | A | * | 10/1969 | McDonnell | 222/211 |
| 3,572,590 | A | * | 3/1971 | Malone | 239/327 |
| 3,897,005 | A | | 7/1975 | Reiner | 239/327 |
| 3,917,116 | A | * | 11/1975 | Mason | 222/92 |
| 4,157,789 | A | * | 6/1979 | Laauwe | 239/327 |
| 4,159,790 | A | * | 7/1979 | Bailey | 222/211 |
| 4,275,840 | A | * | 6/1981 | Staar | 239/327 |
| 4,322,020 | A | * | 3/1982 | Stone | 222/95 |
| 4,328,912 | A | | 5/1982 | Haggar et al. | |
| 4,335,815 | A | * | 6/1982 | Babiol et al. | 206/277 |
| 4,411,623 | A | * | 10/1983 | Axelsson | 433/80 |
| 5,139,168 | A | * | 8/1992 | Gueret | 222/92 |
| 5,156,300 | A | * | 10/1992 | Spahni et al. | 222/105 |
| 5,178,300 | A | * | 1/1993 | Haviv et al. | 222/95 |
| 5,226,568 | A | * | 7/1993 | Newton et al. | 222/212 |
| 5,332,121 | A | * | 7/1994 | Schmidt et al. | 222/95 |
| 5,364,031 | A | * | 11/1994 | Taniguchi et al. | 239/330 |
| 5,713,519 | A | * | 2/1998 | Sandison et al. | 239/8 |
| 5,918,783 | A | * | 7/1999 | Kieras et al. | 222/541.6 |
| 6,016,939 | A | * | 1/2000 | Gueret | 222/494 |
| 6,220,526 | B1 | * | 4/2001 | Johnson | 239/323 |
| 6,273,296 | B1 | * | 8/2001 | Brown | 222/92 |
| 6,460,781 | B1 | * | 10/2002 | Garcia et al. | 239/327 |

FOREIGN PATENT DOCUMENTS

| | | |
|---|---|---|
| EP | 0 761 314 A2 | 3/1997 |
| FR | 2 443 980 | 7/1980 |
| FR | 2 778 639 | 11/1999 |

OTHER PUBLICATIONS

Transtronics website printout, http://xtronics.com/reference/viscosity.htm. May 8, 2003.*

* cited by examiner

*Primary Examiner*—Henry Bennett
(74) *Attorney, Agent, or Firm*—Oblon, Spivak, McClelland, Maier & Neustadt, P.C.

(57) ABSTRACT

A device for containing and dispensing a fluid product, such as a cosmetic product, in the form of a spray. The device includes a reservoir containing the product at substantially atmospheric pressure, with the reservoir having flexible walls that preferably do not have shape memory. The device is equipped with a spray member for spraying the product in response to pressure exerted on the flexible walls of the reservoir, and an anti-air-intake element provided in order to prevent any entry of air inside the reservoir when said pressure ceases. When pressure is applied, the walls are deformed and the product is sprayed from the container. After dispensing is completed, the walls are maintained in the deformed state because air is prevented from entering the container. As a result, the next spraying action occurs more immediately and consistently because the container remains substantially filled with the product as the volume of the container is reduced upon deformation of the container walls.

52 Claims, 4 Drawing Sheets

DEVICE FOR DISPENSING A PRODUCT, PARTICULARLY PRODUCT SAMPLES, AS A SPRAY

CROSS REFERENCE TO RELATED APPLICATIONS

This document claims priority to French application number 0106390 filed May 15, 2001, the entire content of which is hereby incorporated by reference.

FIELD OF THE INVENTION

The invention relates to a device for packaging and dispensing a product, such as a liquid or small/fine powder, in a spray. More particularly, the invention relates to a miniature spray, which is preferably disposable and suitable with packaging for cosmetic product samples, such as perfumes or products for protecting against the harmful rays of the sun. The product is preferably a liquid product, but may also be in the form of a small particle size powder.

BACKGROUND OF THE INVENTION

DISCUSSION OF BACKGROUND

Cosmetic sample or spray type dispensers are known as shown, for example, in FR-A-2 778 639, EP-A-0 761 314, FR-A-2 443 980, or in U.S. Pat. No. 3,897,005 or U.S. Pat. No. 3,412,907. These devices suffer principally from at least one shortcoming associated with their cost of manufacture, difficulty to use, or poor quality of the spray they are capable of generating.

Because samples are not generally intended for sale, their cost of manufacture must be as low as possible. It is thus important to utilize devices formed of components that can be easily mass produced and that can be assembled in a simple manner. Moreover, the devices must be capable of generating a high quality spray to the extent possible, particularly in terms of providing constant or consistent spray characteristics.

U.S. Pat. No. 4,328,912 describes a container for dispensing a product. With this arrangement, a part of the container located in the vicinity of the outlet forms a valve consisting of a hemisphere which is squeezed in order to selectively close off the passage leading to the outlet. An inverse pressure is then applied to the valve to restore the hemispherical shape and permit the product to exit in response to pressure exerted on the walls of the container. A significant problem arising from a configuration of this type lies in the fact that, when the product is dispensed the volume of the dispensed product is replaced by a corresponding volume of air. Therefore, unless the device is turned upside down, the exit of the product, particularly in spray form, becomes increasingly difficult to generate in subsequent uses. Particularly, in the cosmetics field, this upside down dispensing can be most unsuitable and most awkward.

U.S. Pat. No. 5,332,121 and U.S. Pat. No. 5,156,300 describe devices with a flexible pouch arranged inside a compressible container, with the product disposed inside of the flexible pouch. Such devices are suitable for condiments such as ketchup, and thus have no intention or purpose in dispensing the product in a spray form. The products to be dispensed are very viscous and the outlets have a diameter such that even if it were desired (which is not generally the case with ketchup, mustard or mayonnaise) dispensing of the product in a spray form would be impossible to achieve.

SUMMARY OF THE INVENTION

It is an object of the invention to provide a spray device that solves at least some, preferably all, of the problems discussed above with reference to conventional devices.

In particular, it is an object of the invention to provide a device which is easy to mass produce and which is inexpensive to manufacture.

It is a further object of the invention to provide a device which makes it possible to generate a spray of not only satisfactory quality, but also a quality that is consistent and can be reproduced from one device to the next.

Additional objects and advantages will become apparent in the following detailed description. According to one aspect of the invention, a device for spraying a fluid product, such as a cosmetic product, is provided. The device includes a reservoir containing the product substantially at atmospheric pressure. The reservoir has at least one, preferably plural flexible walls, with the walls preferably formed such that they are substantially without shape memory. The device is also equipped with a dispenser head, preferably a spray element for spraying the product in response to a pressure exerted on the flexible walls of the reservoir. An anti-air-intake element is provided in order to prevent entry of air inside the reservoir when the application of pressure ceases.

As used herein, "spray" is to be understood to mean the projection of fine droplets or particles in the form of a mist or cloud. Typically, the average size of the particles or of the droplets is preferably no more than 1 mm. More preferably, the particles or droplets are at most on the order of a few hundred $\mu$m in size, and even more preferably, the particles or droplets are in the range from 5 $\mu$m to 200 $\mu$m in size.

The substantial absence of shape memory in the flexible walls of the container reflects the fact that, when the pressure for generating the exit of the product ceases, the walls remain substantially in their deformed form or condition and do not tend to resume the form they had before pressure was exerted. This characteristic distinguishes the container used according to the invention from conventional containers. In particular, prior containers have been provided in the form of bottles or tubes, for example, containers made from polyethylene, in which the walls can be deformed in order to force the product out of the container via an outlet. With these containers, when the pressure on the walls ceases, the walls have a natural tendency, because of their elasticity to substantially resume the form they had before they were deformed. As a result, air is sucked into the container in order to compensate for the increase in volume of the container. Although the container or reservoir walls of the invention are preferably formed of a material that has no shape memory or little elasticity, even if formed of a material that is elastic or has shape memory, because air is prevented from entering into the container after a spray dispensing operation is completed, the walls of the container will be maintained in a deformed state or an at least partially deformed state. As a result, the next spray operation will provide a consistent good quality spray because the spray will not be interrupted or diminished by air in the container, even if the container is held upright during the subsequent spray operation. By contrast, if substantial amounts of air were allowed to enter the container, the next spraying operation would start with only air being forced from the container and/or dispensing of the product would be inconsistent or interrupted by air. Also, by minimizing the amount of air in the container, pressure exerted upon the container is more rapidly utilized to force the product from the container rather than to compress air inside of the container or to force air from the container.

The spray element of the invention, also known as a diffuser or diffusion head, includes a structure in the form of a nozzle traversed by at least one orifice through which the product is sprayed in the form of a mist or cloud of reasonably fine droplets. There are various types of nozzles that can be utilized, some including one or more swirl or swirling channels capable of accelerating the liquid upstream of the outlet so as to produce still finer particles of liquid. Typically, the orifice via which the product is sprayed has a diameter from 0.2 mm to 1 mm, and preferably from 0.2 mm to 0.7 mm.

According to one of the advantageous characteristics of the invention, by arranging for the product to occupy all or practically all the container during filling, pressure exerted on the flexible walls of the container is transmitted practically in its entirety to the product, such that the product then passes via the diffuser and is sprayed in the manner described above. There is thus little or no loss of charge due to air and no loss of efficiency in spraying the product. Dispensing of the product in spray form is thus easy to achieve, regardless of the level of product remaining in the container and also regardless of the position of use.

With the arrangement of the invention, when pressure on the walls of the container ceases, the absence or practical absence of shape memory of the material forming the container, in combination with the anti-air-intake element which prevents entry of any substantial quantities of air inside the container, means that the device is virtually always in a configuration in which the product occupies substantially the entire volume of the container. Thus, when the consumer presses again on the walls of the container, spraying is immediate.

Preferably, the device is configured such that the actuating pressure is applied directly to the walls of the container, and the inner surface of the walls are in contact with the product to be sprayed. Accordingly, the inertia of the system and inefficiencies are largely reduced. Therefore dispensing, particularly in spray form, is facilitated, especially when the product is to be dispensed by pressure transmitted suddenly to the product.

The flexible walls may be formed from at least one layer of a thermoplastic or metallic material, or from a multi-layer complex based on such materials, with the reservoir configured in the form of a tube, a pouch or a sachet. Preferably, the container is configured in the form of a sachet formed by the superposition of two sheets adhesively bonded or welded along their peripheral edges.

The anti-air-intake element can be configured in the form of a valve opening in a single direction so as to allow the exit of the product in response to pressure inside the reservoir while opposing any entry of air inside the reservoir when said pressure ceases.

A one-way valve of this type can be produced from a thermoplastic or cross linked elastomer, such as silicone, natural or synthetic latex, EPDM, polyurethane or flexible polyvinyl chloride (PVC).

The valve element that opens in one direction can be in the form of a single piece element with the nozzle, which enhances fitting and positioning. Alternatively, the nozzle and the valve may be formed from two or more different pieces, for example, made from different materials.

The diffuser can be fitted onto the reservoir or container by adhesive bonding or welding, preferably with the use of heat.

The device according to the invention is particularly advantageous for packaging and spraying of a sample measure of a cosmetic product, such as a perfume or a product for protecting against the harmful rays of the sun. Although particularly advantageous for cosmetic or skin care products that are in liquid form, as noted earlier, the device can also be used for dispensing other products such as products that are in a powder form. Also, although the invention is particularly advantageous for product samples due to the simplicity in use and manufacture (low cost), aspects of the invention could also be advantageously utilized in typical consumer product sized containers.

Apart from the arrangements described above, it is to be understood that various aspects of the invention can be utilized in various forms or types of containers. Arrangements are described below as non-limiting illustrative embodiments.

BRIEF DESCRIPTION OF THE DRAWINGS

A better appreciation of the invention and many of the attendant advantages thereof will become further apparent from the following detailed description, particularly when read in conjunction with the accompanying drawings of which.

DETAILED DESCRIPTION OF THE PREFERRED EMBODIMENTS

Figure 1A:
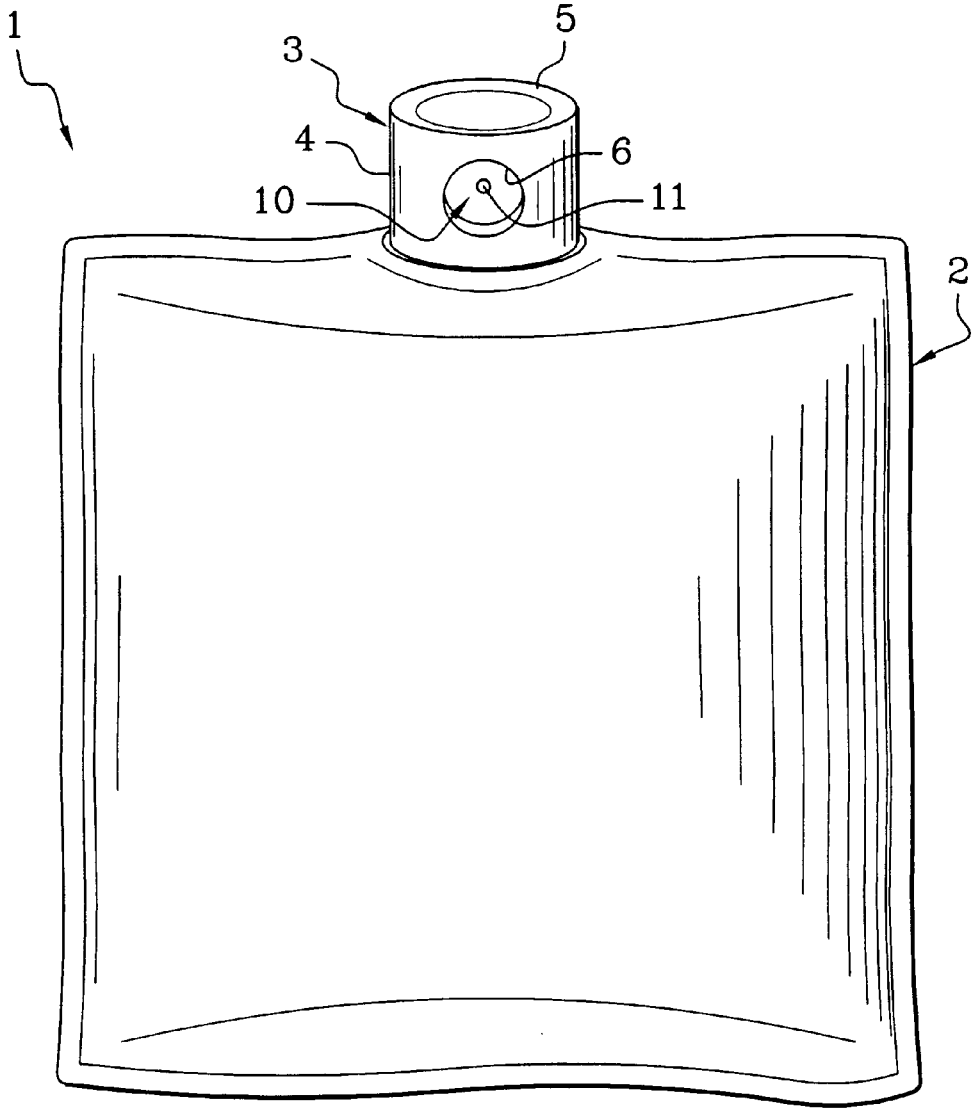
FIGS. 1A–1B depict a preferred embodiment of the device in the rest or non-dispensing position.
Figure 1B:
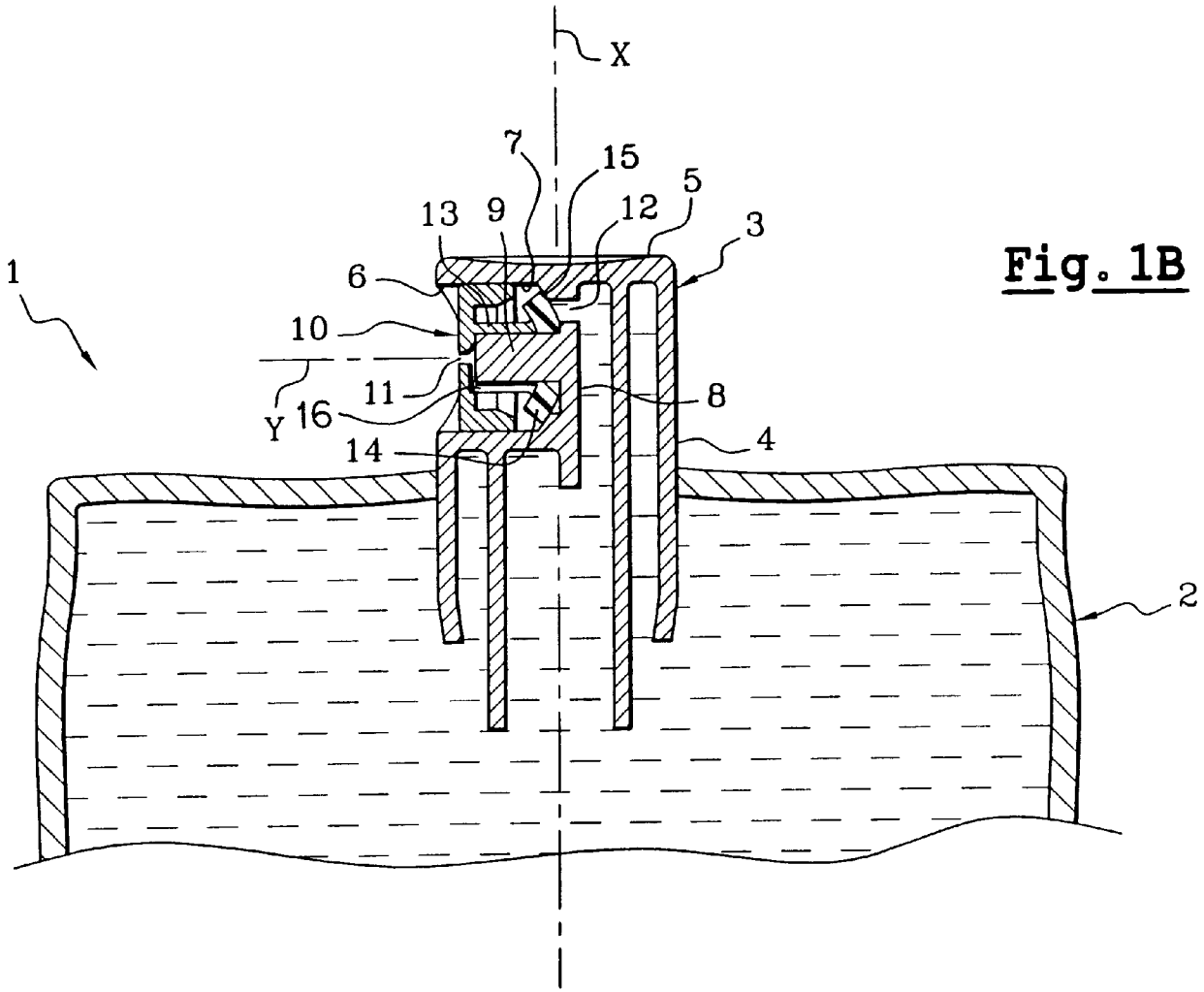

The device 1 shown overall in FIG. 1A and in sectional view in FIG. 1B is configured in the form of a rectangular sachet 2 obtained by the superposition of two sheets of flexible material. By way of example, the sheets can each be a metal/plastic complex or laminate such as sheets of polyethylene/aluminum/polyethylene (PET/alu/PET) joined by adhesive bonding or welding along their peripheral edges. A diffusion head 3 or diffuser is fixed, for example by adhesive bonding, between the respective upper edges of the two sheets. Although a sachet is depicted, as noted earlier, the container can have various forms, such as a tube or pouch, and although two flexible walls are depicted, the container could have one flexible wall or could be formed of more than two flexible walls.

The dispensing head is preferably in the form of a diffuser or diffusion head 3 which has a generally cylindrical shape and includes a part arranged inside the sachet 2. The other part emerges outside the sachet. The diffusion head 3 includes an outer skirt 4 on the outer surface of which corresponding portions of the upper edges of the sachet 2 are adhesively bonded.

The end of the skirt 4 arranged inside the sachet 2 is open so as to be in communication with the product contained inside the sachet 2. The other end of the outer skirt 4, located outside the sachet 2, is closed by a transverse wall 5.

On a portion located outside the sachet 2, the outer skirt 4 includes an orifice 6 formed at the end of a housing 7. In the illustrated embodiment as shown in FIG. 1B, the orifice 6 is orientated along an axis Y which is substantially perpendicular to an axis X of the diffusion head 3. As also shown in FIG. 1B, at the opposite or inner end of the orifice 6, the housing 7 is closed by a base 8.

The diffusion head 3 can be formed, for example, by molding a thermoplastic material, such as a polyethylene or a polypropylene.

A stud 9 projects from the base 8, substantially along the axis Y of the housing 7. A free end of the stud 9 is located slightly back or recessed from the plane of the opening of the orifice 6. The stud 9 forms a center post, delimiting, together with the inner surface of a nozzle 10, a chamber with one or more swirling channels 16 intended to accelerate the liquid before it passes through an outlet 11, with the swirling channel(s) traversing the nozzle 10 and oriented along the axis Y of the housing 7. The chamber with swirling channels and the outlet 11 are supplied selectively via an orifice 12 traversing the base 8 of the housing 7. The nozzle is produced, for example, from polyethylene or polypropylene. The nozzle 10 is fitted onto the diffusion head 3 by any suitable means, for example, by adhesive bonding, welding, clamping or snap-fitting.

The diffusion head includes a movable member to allow the product to flow therethrough in a first direction to exit the container, but air is prevented from flowing in a reverse direction to prevent air from flowing into the container. In the preferred form, the movable member is a flexible element (14) that flexes to cover and uncover an orifice (12) in the diffusion head. As shown in the drawings, the inner surface of the nozzle 10 includes a skirt portion 13 that has a free end which serves to hold an elastomeric annular element 14 in engagement against the base 8 of housing 7, opposite the orifice 12. Held in this way, the annular element 14 behaves as a valve which opens in one flow direction. Thus, when the product contained in the sachet 2 is under pressure, the annular element 14 can flex in the direction of the housing 7 (toward the outlet 11) so as to allow the product to pass via the orifice 12. The product can then supply the swirl channel chamber and be sprayed via the outlet 11. Conversely, as the peripheral edge of the valve 14 bears, in the absence of the application of pressure on the sachet 2 side, against an annular seat 15 formed by the base 8 of the housing 7, such that the valve 14 cannot open in the other direction. Thus, particularly when dispensing of the product ceases, air cannot be sucked into the sachet 2 via the orifice 12.

Figure 2A:
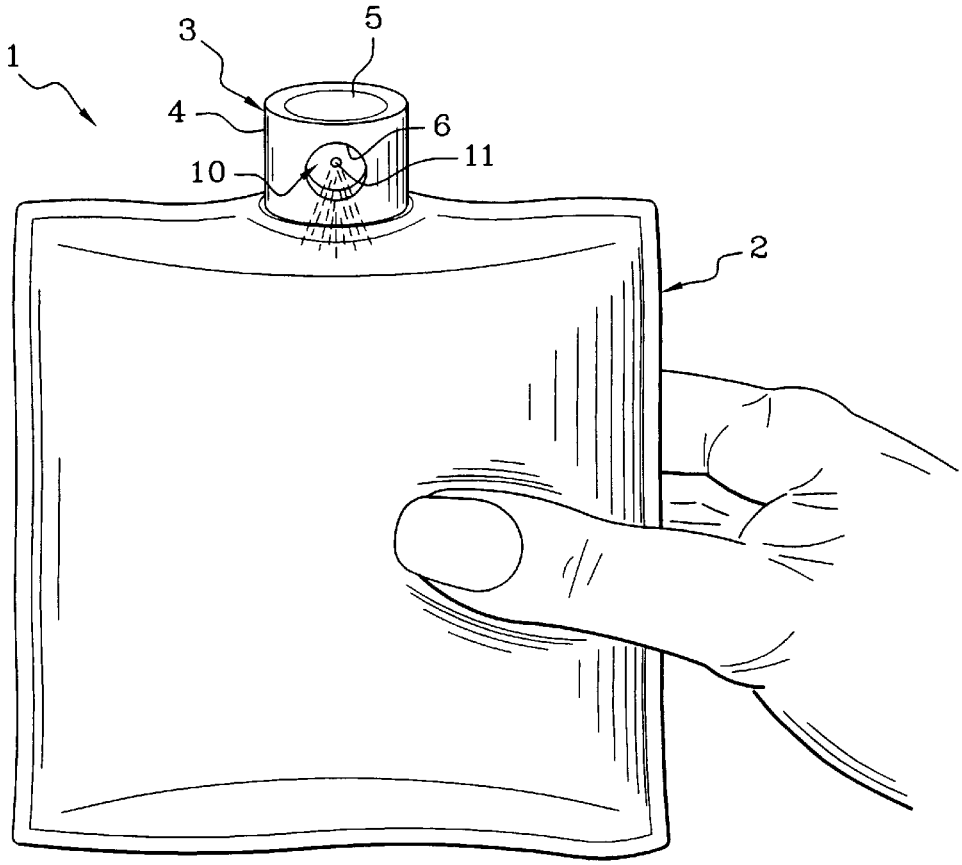
FIGS. 2A–2B show the device in FIGS. 1A and 1B in the dispensing position.
Figure 2B:
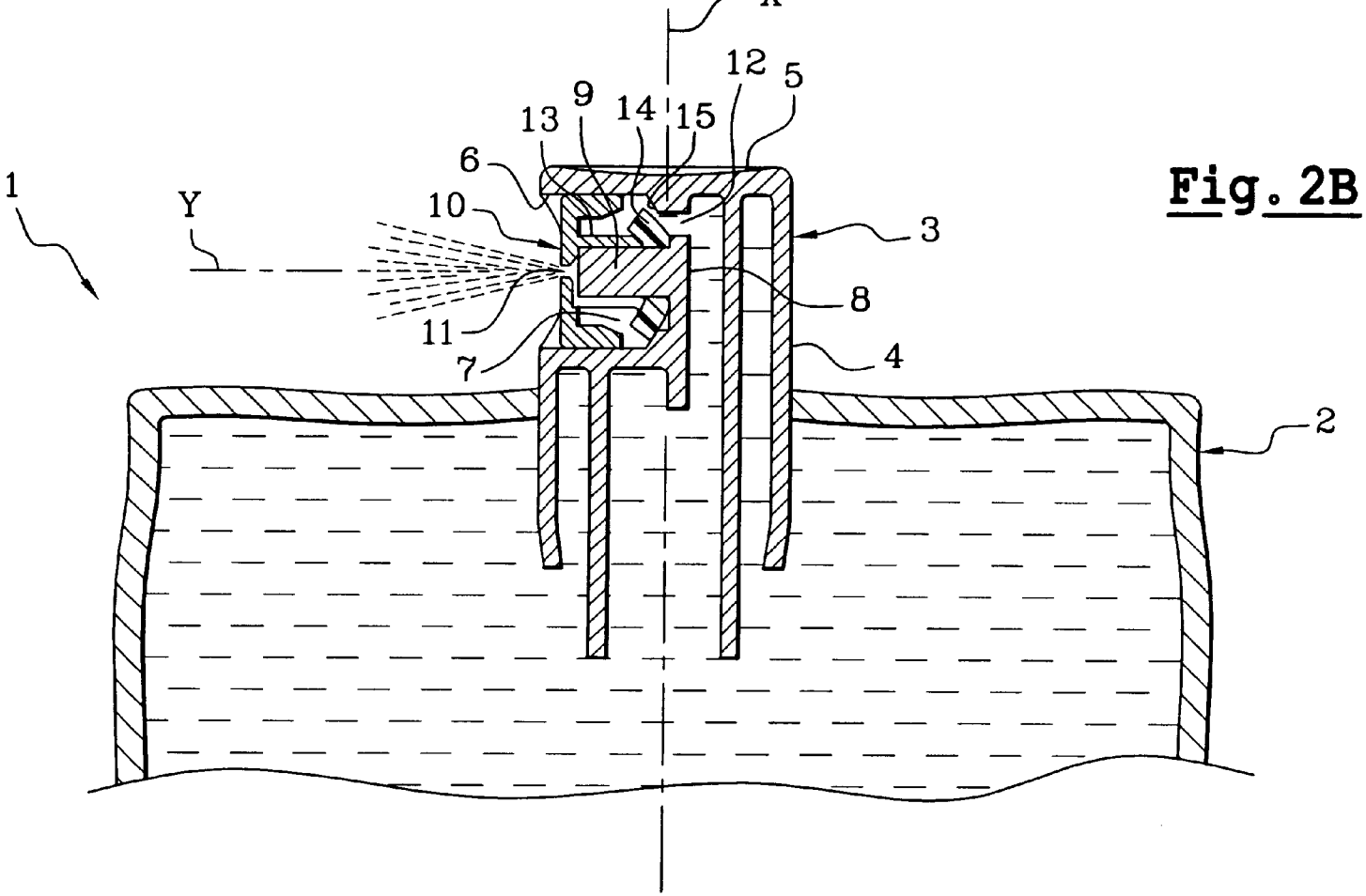

In order to spray the contents of the sachet 2, the user, in the manner illustrated in FIG. 2A, presses on an exposed outer surface of the walls of the sachet 2, preferably in a direction perpendicular to the mid-plane of the sachet. The force exerted on the walls of the sachet is transmitted entirely to the liquid which occupies substantially the entire volume of the sachet 2. Under the pressure of the product, the valve 14 flexes in the direction of the housing 7 as partly to clear the orifice 12 traversing the base 8 of the housing 7 (FIG. 2B). The product thus passes into the housing 7 and into the chamber having the swirling channels delimited by the nozzle 10 in combination with the center post 9. The liquid is then sprayed in the form of a cloud or mist of fine droplets in via the outlet 11.

When the pressure on the walls of the sachet 2 ceases, the valve 14 returns elastically to bear on the seat 15 and thus opposes any entry of air in the direction of the sachet 2. Preferably, the walls of the sachet 2 are not elastic such that they better retain the deformation resulting from pressure they have undergone. Thus, even after the dispensing of only a portion of the contents of the sachet 2, the liquid permanently occupies all or substantially all of the volume of the sachet. Therefore, upon each subsequent use, spraying is more immediate and of good quality.

Obviously, numerous modifications and variations of the present invention are possible in light of the above teachings. It is therefore to be understood that, within the scope of the appended claims, the invention may be practiced otherwise than as specifically described herein.

What is claimed is:

1. A device for containing and spraying a product comprising:

a reservoir containing the product, said reservoir including at least one flexible wall;

a diffuser coupled to the reservoir for spraying the product through an orifice, said diffuser including an anti-air-intake element that prevents air from entering said reservoir through said diffuser; and wherein application of pressure to said at least one flexible wall forces said product through said diffuser to be sprayed from said diffuser, and wherein when the application of pressure ceases air is prevented from entering said reservoir by said anti-air-intake element, wherein said diffuser is coupled to the reservoir via a channel oriented along a first axis and said orifice is oriented along a second axis distinct from said first axis.

2. A device as recited in claim 1, wherein said at least one flexible wall has an exposed outer surface and an inner surface and wherein said inner surface is in contact with said product and pressure can be applied to said exposed outer surface to pressurize said product.

3. A device as recited in claim 1, wherein said at least one flexible wall is formed of a material that includes a thermoplastic material.

4. A device as recited in claim 1, wherein said at least one flexible wall includes a thermoplastic material and a metallic material.

5. A device as recited in claim 1, wherein said reservoir is formed of at least two flexible walls each formed of a material that includes a thermoplastic material and a metallic material, and wherein said at least two walls are coupled to each other at their respective peripheries such that said reservoir is in the form of a sachet.

6. A device as recited in claim 1, wherein said at least one flexible wall is formed of a material that includes a metallic material.

7. A device as recited in claim 1, wherein said reservoir is one of a tube, a pouch and a sachet.

8. A device as recited in claim 7, wherein said at least one flexible wall is formed of a material that includes a thermoplastic material and a metallic material.

9. A device as recited in claim 1, wherein said orifice has a diameter in the range of 0.2 mm to 1 mm.

10. A device as recited in claim 9, wherein said orifice has a diameter in the range of 0.2 mm to 0.7 mm.

11. A device as recited in claim 1, wherein said anti-air-intake element includes a movable member disposed over said orifice, and wherein flow of product in a first direction from said reservoir to an exterior of said device moves said movable member in a direction away from said orifice to uncover said orifice and allow said product to flow through said diffuser, and wherein a flow of air in a second direction opposite to said first direction urges said movable member toward said orifice such that said movable member is maintained over said orifice to cover said orifice and prevent air from entering into said reservoir through said diffuser.

12. A device as recited in claim 11, wherein said movable member is formed of a flexible material such that flexing of said movable member causes said movable member to move to cover and uncover said orifice.

13. A device as recited in claim 12, wherein said flexible material comprises at least one of a thermoplastic material and a cross linked elastomer.

14. A device as recited in claim 12, wherein said movable member includes a portion that is fixedly coupled to said diffuser.

15. A device as recited in claim 11, wherein said movable member is formed of at least one of silicone, natural latex, synthetic latex, EPDM, polyurethane and a flexible polyvinyl chloride.

16. A device as recited in claim 11, wherein said diffuser includes a nozzle having at least one orifice, and wherein said diffuser further includes at least one swirl channel.

17. A device as recited in claim 16, wherein said diffuser includes a base through which said orifice extends, and wherein a portion of said movable member is positioned between said base and a portion of said nozzle to fixedly position said portion of said movable member.

18. A device as recited in claim 16, wherein said diffuser includes a stud and said at least one swirl channel is at least partially defined between said stud and said nozzle.

19. A device as recited in claim 1, wherein said diffuser includes a nozzle having at least one outlet, and wherein said diffuser further includes at least one swirl channel.

20. A device as recited in claim 1, wherein said diffuser is coupled to said reservoir by one of adhesive bonding and welding.

21. A device as recited in claim 1, wherein said product is a cosmetic product.

22. A device as recited in claim 1, wherein said product is a sunscreen.

23. A device as recited in claim 1, wherein said product is a perfume.

24. A device as recited in claim 1, wherein said reservoir is formed of first and second flexible sheets, and wherein said first and second flexible sheets are coupled to each other about respective peripheries of the first and second flexible sheets except that the first and second flexible sheets are not coupled at a selected portion of their respective peripheries, and wherein said diffuser is positioned between and coupled to the first and second flexible sheets at said selected portion.

25. A device as recited in claim 1, wherein said first axis is substantially perpendicular to said second axis.

26. A device according to claim 1, wherein said channel is in direct communication with said product located in a top portion of said reservoir.

27. A device according to claim 26, wherein said reservoir is free of any tube connecting said channel to a bottom portion of said reservoir.

28. A device for containing and spraying a product comprising:

a reservoir containing the product, said reservoir including at least one flexible wall;

a diffuser coupled to the reservoir for spraying the product, said diffuser including an anti-air-intake element that prevents air from entering said reservoir through said diffuser; and wherein application of pressure to said at least one flexible wall forces said product through said diffuser to be sprayed from said diffuser, and wherein when the application of pressure ceases air is prevented from entering said reservoir by said anti-air-intake element, wherein said diffuser includes a nozzle having at least one outlet, and wherein said diffuser further includes at least one swirl channel, and wherein said diffuser includes a stud and said at least one swirl channel is at least partially defined between said stud and said nozzle.

29. A device according to claim 28, wherein said diffuser is in direct communication with said product located in a top portion of said reservoir.

30. A device according to claim 29, wherein said reservoir is free of any tube connecting said diffuser to a bottom portion of said reservoir.

31. A device for containing and dispensing a product comprising:

a container containing the product, said container including a container volume which is at least partially defined by at least one flexible wall having an inner surface and at least one exposed outer surface on an exterior of said container, wherein said inner surface is in contact with said product and said at least one exposed outer surface is exposed to a user's touch;

a dispensing head coupled to said container, said dispensing head including a one-way valve such that said product can pass from said container and through said dispensing head to exit said container but air is prevented from entering said container through said dispensing head, wherein said one-way valve comprises a movable member having a fixed inner portion and an outer peripheral portion movable from a closed position to an open position; and wherein application of pressure by said user to said at least one exposed outer surface deforms said at least one flexible wall to pressurize the product disposed in said container and said product passes through said dispensing head by way of said one-way valve in said open position to exit said container, and wherein when application of said pressure to said at least one exposed outer surface is stopped air is prevented from entering said container by said one-way valve in said closed position and said at least one flexible wall is maintained in an at least partially deformed state.

32. A device as claimed in claim 31, wherein said container volume has a size which successively decreases as said product is successively dispensed from said container.

33. A device as recited in claim 32, wherein said dispensing head is a diffuser which dispenses said product as a spray.

34. A device as recited in claim 31, wherein said dispensing head is a diffuser which dispenses said product as a spray.

35. A device as recited in claim 34, wherein said product is a cosmetic composition.

36. A device as recited in claims 34, wherein said product is a perfume.

37. A device as recited in claim 34, said product is a skin care product.

38. A device as recited in claim 34, wherein said product includes a sunscreen.

39. A device as recited in claim 34, wherein said container is formed of first and second flexible sheets, and wherein said first and second flexible sheets are coupled to each other about respective peripheries of the first and second flexible sheets except that the first and second flexible sheets are not coupled at a selected portion of their respective peripheries, and wherein said dispensing head is positioned between and coupled to the first and second flexible sheets at said selected portion.

40. A device as recited in claim 34, wherein said a movable member is disposed over an orifice, and wherein flow of product in a first direction from said container to an exterior of said device moves said movable member in a direction away from said orifice to uncover said orifice and allow said product to flow through said dispensing head, and wherein a flow of air in a second direction opposite to said first direction urges said movable member toward said orifice such that said movable member is maintained over said orifice to cover said orifice and prevent air from entering said container through said dispensing head.

41. A device as recited in claim 40, wherein said dispensing head includes a nozzle having at least one outlet, and wherein said dispensing head further includes at least one swirl channel.

42. A device as recited in claim 41, said dispensing head includes a base through which said orifice extends.

43. A device as recited in claim 42, wherein said dispensing head includes a stud and said at least on swirl channel is at least partially defined between said stud and said nozzle.

44. A device as recited in claim 40, wherein said movable member is formed of a flexible material such that flexing of said movable member causes said movable member to move to cover and uncover said orifice.

45. A device as recited in claim 44, wherein said dispensing head comprises a stud and said inner portion of said movable member is fixed to said stud.

46. A device as recited in claim 31, wherein said container is formed of first and second flexible sheets, and wherein said first and second flexible sheets are coupled to each other about respective peripheries of the first and second flexible sheets except that the first and second flexible sheets are not coupled at a selected portion of their respective peripheries, and wherein said dispensing head is positioned between and coupled to the first and second flexible sheets at said selected portion.

47. A device for containing and dispensing a product comprising:

a container containing the product, said container including a container volume which is at least partially defined by at least one flexible wall;

a diffuser coupled to said container, said diffuser including:

a nozzle, a stud, at least one swirl channel at least partially defined between said stud and said nozzle, and a one-way valve such that said product can pass from said container and through said diffuser to exit said container but air is prevented from entering said container through said diffuser; and wherein application of pressure to said at east one flexible wall deforms said at least one flexible wall to pressurize the product disposed in said container and said product passes through said diffuser by way of said one-way valve to exit said container, and wherein when application of said pressure to said at least one flexible wall is stopped air is prevented from entering said container by said one-way valve and said at least one flexible wall is maintained in an at least partially deformed state.

48. A device for containing and dispensing a product comprising:

a container containing the product, said container including a container volume which is at least partially defined by at least one flexible wall;

a dispensing head in communication with said container via a channel oriented along a first axis of said dispensing head, said dispensing head defining a housing in communication with said channel and including a stud extending inside said housing along a second axis of said dispensing head perpendicular to said first axis, said housing defining an orifice for dispensing said product, said orifice being positioned on said second axis, said dispensing head further including a one-way valve between said channel and said housing such that said product can pass from said container and through said dispensing head to exit said container but air is prevented from entering said container through said dispensing head; and wherein application of pressure to said at least one flexible wall deforms said at least one flexible wall to pressurize the product disposed in said container and said product passes through said dispensing head by way of said one-way valve to exit said container, and wherein when application of said pressure to said at least one flexible wall is stopped air is prevented from entering said container by said one-way valve and said at least one flexible wall is maintained in an at least partially deformed state.

49. A device according to claim 48, wherein said stud forms a center post in said housing and has an end facing said orifice.

50. A device according to claim 48, wherein said housing includes at least one swirling channel oriented along said second axis.

51. A device according to claims 48, wherein said channel is in direct communication with said product located in a top portion of said container.

52. A device according to claim 51, wherein said container is free of any tube connecting said channel to a bottom portion of said container.

* * * * *

UNITED STATES PATENT AND TRADEMARK OFFICE

CERTIFICATE OF CORRECTION

PATENT NO. : 6,742,724 B2
DATED : June 1, 2004
INVENTOR(S) : Florent Duqueroie

It is certified that error appears in the above-identified patent and that said Letters Patent is hereby corrected as shown below:

Column 9,
Line 4, replace “on” with -- one --.
Line 37, replace “east” with -- least --.

Column 10,
Line 39, replace “claims” with -- claim --.

Signed and Sealed this

Ninth Day of November, 2004

JON W. DUDAS
*Director of the United States Patent and Trademark Office*